US006070736A

United States Patent [19]

Ballman et al.

[11] Patent Number: 6,070,736

[45] Date of Patent: Jun. 6, 2000

[54] SEALING MECHANISM AND METHOD FOR SCREENING MACHINES

[75] Inventors: Brady P. Ballman, Loveland; William W. Heyob, Cincinnati, both of Ohio

[73] Assignee: Rotex, Inc., Cincinnati, Ohio

[21] Appl. No.: 09/189,013

[22] Filed: Nov. 9, 1998

[51] Int. Cl.[7] ..... B07B 1/34

[52] U.S. Cl. ..... 209/325; 209/404; 209/405; 209/413

[58] Field of Search ..... 209/394, 395, 209/398, 399, 402, 403, 404, 405, 411, 412, 413, 325, 326, 331, 332

[56] References Cited

U.S. PATENT DOCUMENTS 2,544,822 3/1951 Brown .
3,239,218 3/1966 Reeves .
4,354,770 10/1982 Block .
4,457,839 7/1984 Bailey ..... 209/403 X
4,570,757 2/1986 Marzullo .
4,582,597 4/1986 Huber ..... 209/403 X
5,037,536 8/1991 Koch et al. .
5,090,840 2/1992 Cosenza .
5,226,546 7/1993 Janssens et al. .
5,392,925 2/1995 Seyffert .
5,485,924 1/1996 Zaun .
5,811,003 9/1998 Young et al. ..... 209/403 X

*Primary Examiner*—David H. Bollinger
*Attorney, Agent, or Firm*—Wood, Herron & Evans, L.L.P.

[57] ABSTRACT

A screen frame and screen are secured into sealing engagement within a screening machine by a screen frame sealing mechanism and method which allows the user to simultaneously raise an entire side of the screen frame into sealing engagement. Advantageously, the entire screen frame can be raised into sealing engagement to prevent the escape of fine material being screened and avoid metal-to-metal contact during the screening process from a single location.

32 Claims, 3 Drawing Sheets

SEALING MECHANISM AND METHOD FOR SCREENING MACHINES

BACKGROUND OF THE INVENTION

This invention relates to screening machines of the type used to separate or classify mixtures of solid particles of different sizes. The invention also relates to screening machines of the type used for liquid/solid separations, i.e., for separating solid particles of specific sizes from a liquid in which they are carried. More particularly, the invention relates to a mechanism and method for sealing components within the screening machine.

In screening machines of the type described, a screen (which may be woven, an aperture plate or another design) is mounted in what is often called a "screen frame" or "screen deck" which includes a supporting peripheral frame around the perimeter of the screen. Typically associated with this screen frame are other material handling elements which are moved with the screen frame and form walls or partitions above or below the screen frame for containing the liquid and/or particulate materials adjacent to the screen and directing them to appropriate outlets. These elements may comprise a top cover and a pan beneath the screen frame. In the case of screening machines with multiple screens or deck units, spacer pans or frames are provided between the multiple screens.

The screen frames are often removed from the screening machines for cleaning, replacement, readjustment or installation of a screen of a different mesh size or the like. The screen frame is releasably mounted to a carrier, frame, table or box to which vibratory motion is imparted, typically by one or more eccentric motors or other means of excitation. The carrier, frame, table or box is referred to herein as a "vibratory carrier". The vibratory carrier may be moved in oscillatory, vibratory, gyratory, gyratory reciprocating, fully gyratory, rotary or another type of motion or combinations thereof, all of which are herein collectively referred to as "vibratory" motion or variations of that term.

In large commercial screening machines, the weight of the various components including the screen assembly carried by the vibratory carrier, and the weight of the material being processed on the screen assembly may total several hundred pounds or more. This presents a very substantial inertial mass which resists the changes of motion applied thereto by the vibratory drive acting through the vibratory carrier. As a result of these inertial forces, a relative motion may exist between the vibratory carrier and the screen frame. Typically, the screen frame and vibratory carrier are each constructed of metal which could result in significant noise, wear or damage due to the relative motion or rubbing action therebetween. The resulting impact forces between the screen frame and vibratory carrier significantly increase the stresses on the components and reduce their useful life.

Reducing the metal-to-metal contact minimizes the wear on the various metal components and the noise associated with the operation of the screening machine. In some screening machines, a seal is provided between the screen frame and adjacent components such as other screen frames or the vibratory carrier. The seal prevents the escape of material from the screen frame and reduces the detrimental metal-to-metal contact between the screen frame and adjacent components. Currently, certain screen frame designs may not be sealed or secured relative to the remainder of the screening machine, particularly in larger screening machines. This results in the above-described metal-to-metal contact between the screen frame and the remainder of the screening machine and prevents the screening of very fine material, such as sand or the like. The screen frames in larger screening machines are typically inserted and/or removed from the machine in a generally horizontal direction typically through an opening or slot at the head or foot end of the machine or on the side of the machine. This method of installation and removal of the screen frame is detrimental to known sealing arrangements because a seal which would engage the screen frame could be torn or damaged during the installation/removal of the screen frame. In other screening machines, the screen frame is inserted vertically, typically from the top of the machine.

One known sealing mechanism for screening machines is disclosed in U.S. Pat. No. 5,226,546 which relates to a pneumatic seal that is inflated to raise up the screen frame for engagement with a seal. However, pneumatic systems such as those shown in the identified patent often leak thereby lowering the seal pressure. Furthermore, pneumatic systems require an air source at the machine location and traditionally are only used with the insertion/removal of the screen frame through the top of the machine in a generally vertical direction. Furthermore, screening machines with multiple screens and screen frames may require many or all of the screen frames to be removed for access to an individual screen frame. Furthermore, inspection of the resulting seal in pneumatic systems is not readily available.

Known alternatives to pneumatic sealing systems for screening machines include mechanical clamps or locks located at a number of spaced locations on the sides of the machine. One example of this type of known mechanism is disclosed in U.S. Pat. No. 5,392,925. However, to clamp each of the screens in place, the user must progressively move along a first side of the machine tightening and adjusting each of the individual mechanism and then proceed to the opposite side of the machine and repeat the same procedure. This mode of operation is inefficient, time consuming and inconvenient for the user. Additionally, the user can not easily inspect the resulting seal when going from clamp site to clamp site in such systems. Furthermore, the screen frames utilized in screening machines with known mechanical sealing mechanisms must be robust and heavy because they are supported at individual spaced locations by the clamps.

Therefore, it is apparent that there is a need for a sealing mechanism and method for screening machines which avoids metal-to-metal contact between the screen frame and adjacent components of the screening machine without the disadvantages associated with known pneumatic or mechanical sealing systems.

SUMMARY OF THE INVENTION

The present invention solves these and other problems with known sealing mechanisms and methods for screening machines. In a presently preferred embodiment, this invention is a sealing mechanism and method in which a screen frame, after it is installed either vertically through the top of the machine or horizontally through an opening in the head or foot end of the machine, is forced upwardly in a generally vertical direction into contact with a seal mounted on the vibratory carrier.

Once it is inserted, the screen frame is supported on a pair of screen frame lifting rails each located on one longitudinal side of the screen frame. A seal bar is contained within each screen frame lifting rail and includes a number of spaced ramps with inclined ramp surfaces. A corresponding number of lifting links project through the screen frame lifting rail for engagement and cooperation with the inclined surfaces of the ramps.

An actuator in the form of a drive bolt is threadably coupled to the seal bar and can be accessed by a user at the front end of the screening machine. Rotation of the drive bolt actuator translates the seal bar generally horizontally relative to the screen frame lifting rail and associated links. As the seal bar is pulled in a first direction by the drive bolt, the screen frame lifting rail is raised as a result of the interaction between each lifting link and the associated inclined surface of the ramps. As the lifting rail is raised, the screen frame is likewise raised into a sealing engagement with the seal and corresponding portions of the vibratory carrier. A screen frame lifting rail, seal bar and actuator are preferably provided on each longitudinal side edge of the screen frame.

Advantageously, the sealing mechanism and associated method of this invention provide for the sealing of the screen frame against the vibratory carrier or other adjacent structure of the screening machine to inhibit or prevent detrimental metal-to-metal contact and the escape of fine material located on the screen, such as sand or the like, while still providing for the capability of inserting the screen frame horizontally through the end of the screening machine. Moreover, the screen frames, when disengaged from the seal, can be inserted and removed without detrimental damage to the seal. Additionally, the sealing force is adjustable via the actuator and a detent provided on the threaded drive bolt. Visual inspection of the seal during the raising of the screen frame is also possible to ensure uniform and even sealing pressure against the vibratory carrier.

Importantly, the sealing mechanism of this invention can be fully activated from one end of the machine only and does not require the user to go from side to side to actuate individual sealing mechanisms. Moreover, both sides of the screen frame can be raised to a sealing engagement within seconds and the screen frame is supported along its entire length at each longitudinal side by the lifting rail so that the screen frames can be less robust or heavy for a particular application. Additionally, the screen can be tensioned and retained in the screen frame by spring clips as is well known in the art while still affording a positive sealing engagement with the vibratory carrier.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
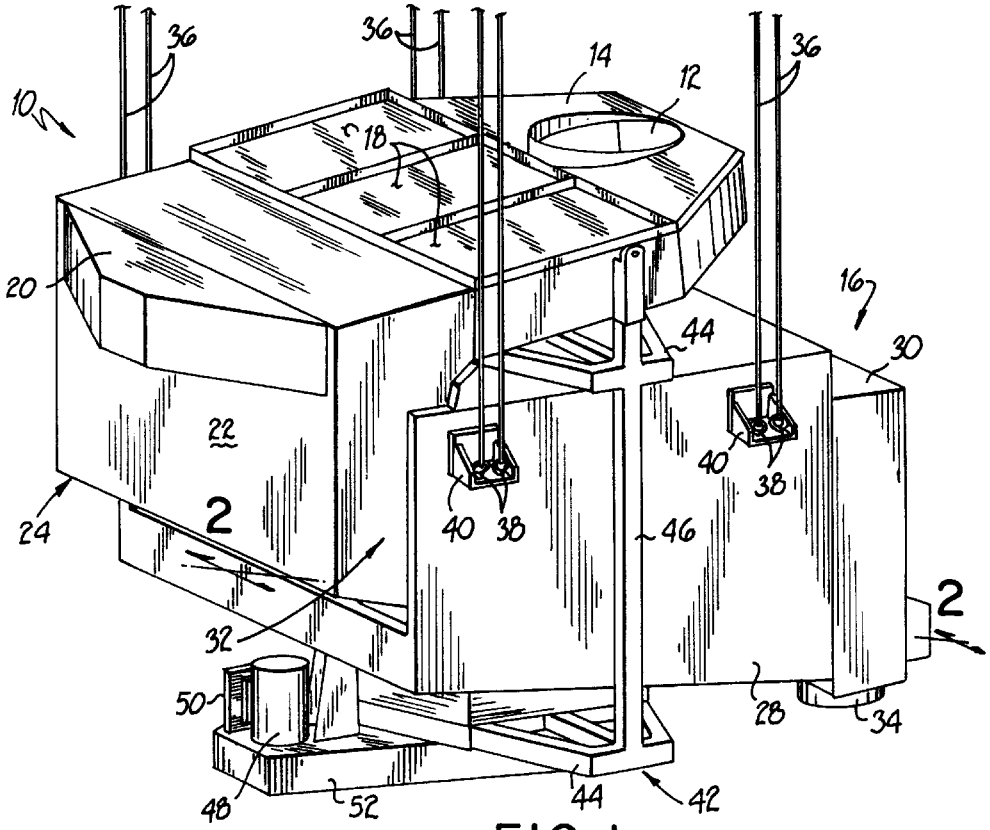
FIG. 1 is a perspective view of an exemplary screening machine.

Referring to FIG. 1, an embodiment of a screening machine 10 in which the present invention may be used is shown. Screening machines of the type shown in FIG. 1 are sold commercially as Megatex machines from Rotex, Inc. of Cincinnati, Ohio, the assignee of this invention. However, this invention is not limited to any particular type of screening machine design and the Megatex machine of FIG. 1 is shown for illustrative purposes.

The screening machine 10 includes an inlet port 12 on an inlet section 14 at the top of the machine 10 proximate a foot end 16 thereof. The screening machine also includes a top cover 18 in the form of a plurality of roof panels. The particulate or other material to be screened is fed into the inlet port 12 for screening and processing by the machine 10. Downstream from the inlet port 12 is a foreign material scalp 20 to remove and separate foreign material from the matter to be screened. Located below the foreign material scalp 20 is a front cover 22 at a head end 24 of the machine 10 which combines with a pair of opposed sidewalls 28 and an end wall 26 at the foot end 16 which is covered by one or more pivotally mounted doors 30 at the foot end to define a screening chamber 32. Positioned below the screening chamber 32 at the foot end 16 is a discharge port 34 through which the material processed by the screening machine 10 is discharged.

The screening machine 10 of the type shown in FIG. 1 is suspended by a plurality of cables 36 each of which pass through the opening in an eyebolt 38 which is threadably or otherwise secured to one of four suspension brackets 40 mounted to the sidewall 28 of the screening machine 10. The screening machine 10 is suspended by the cables 36 to avoid loads on the floor (not shown) below the machine and isolate vibrations due to the large size and mass of the screening machine 10 of the type shown in FIG. 1.

The screening machine 10 is supported structurally by a box frame 42 including upper and lower diamond-shaped sub-frames 44 connected together by a vertically oriented strut 46 on each side of the screening machine 10. The screening machine 10 includes an electric motor 48 attached to a motor mount 50 and supported on a belt guard frame 52 below the machine 10. The motor 48 is coupled by a belt (not shown) to a drive weight (not shown) supported on the belt guard to impart an oscillatory, vibratory, gyratory, gyratory reciprocating, fully gyratory, other motion or combinations thereof (herein collectively referred to as "vibratory" motion or variations of that term). In the specific case of the screening machine 10 of FIG. 1, the motion is gyratory.

Figure 2:
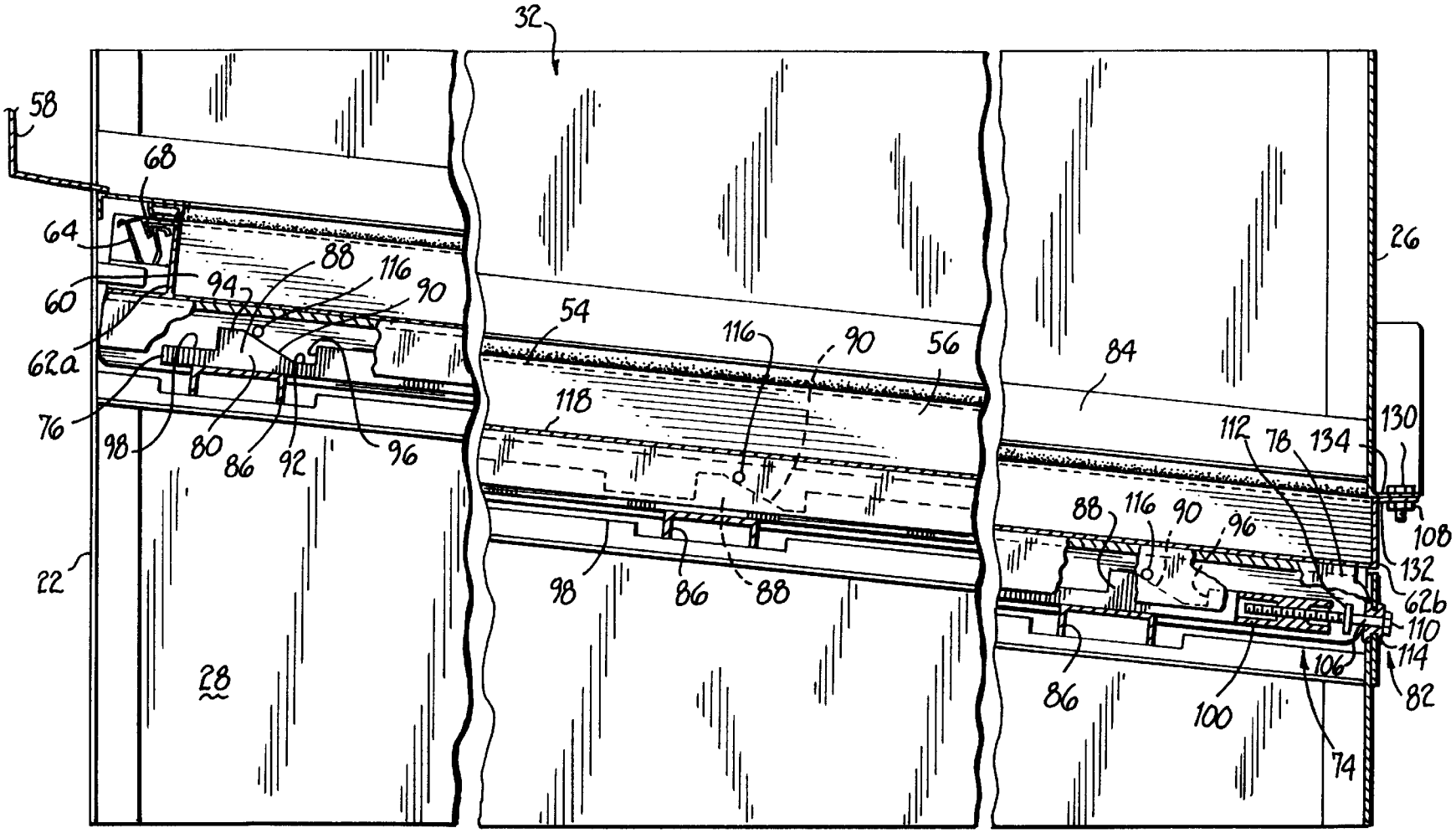
FIG. 2 is a cross-sectional view taken along line 2—2 of FIG. 1 showing a presently preferred embodiment of a sealing mechanism of this invention.

Referring to FIGS. 2–5, within the screening chamber 32 of the screening machine 10, one or more screens 54 are mounted in a screen frame 56 to receive the material being screened from a feed chute 58 at the head end 24 of the machine 10. As shown in FIG. 2, the screen 54 and screen frame 56 are mounted on slightly sloping planes (approximately 6°) with the head end thereof being slightly elevated relative to the foot end so that during the screening process the material advances, generally by gravity, toward the foot or discharge end of the machine 10. Even though the screen frame 56, screen 54 and related structure of the screening machine are on a slightly sloping plane, to provide a reference for the purposes of clarity herein, the screen 54 and screen frame 56 will be considered to define a generally horizontal plane and the direction perpendicular or orthogonal to the screen frame will generally be referred to as a vertical orientation, direction or attitude.

Figure 5:
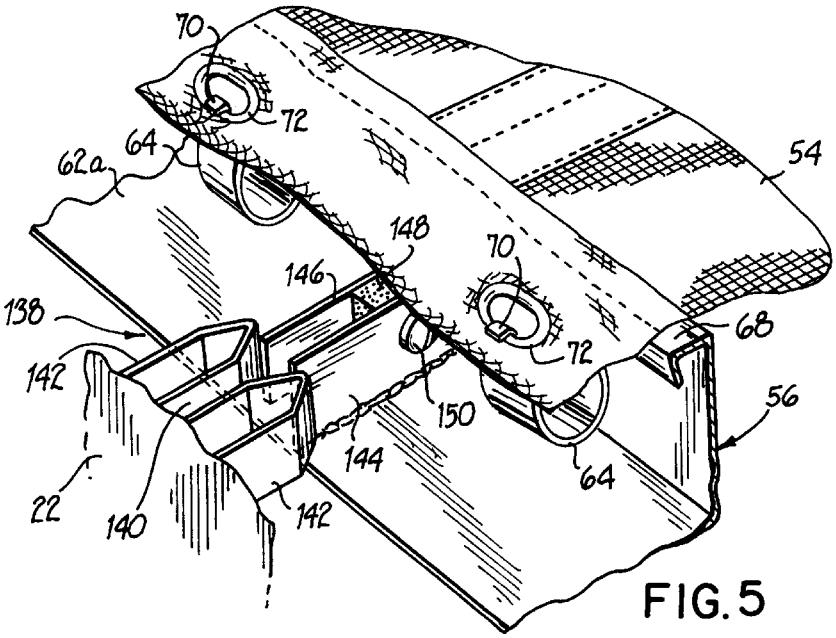
FIG. 5 is an enlarged view of the screen frame and screen retained thereon by spring clips and of a horizontal restraint coupling the screen frame to the vibratory carrier of the screening machine.
Figure 4:
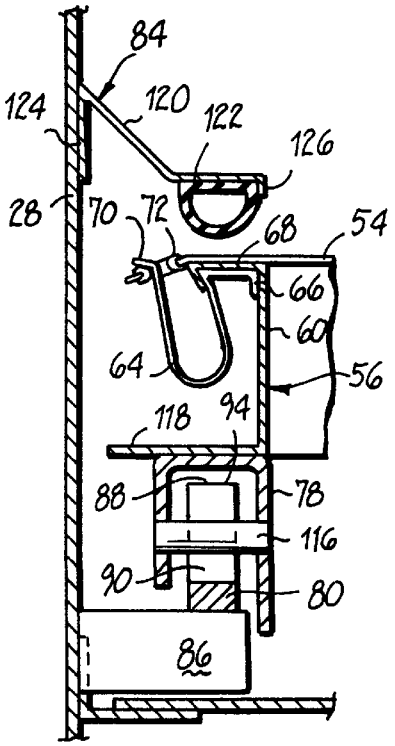
FIGS. 4 and 4A are enlarged cross-sectional views taken along line 4—4 of FIG. 3 showing the screen frame in non-sealing engagement and sealing engagement, respectively, with a seal mounted on a vibratory carrier of the screening machine.
Figure 4A:
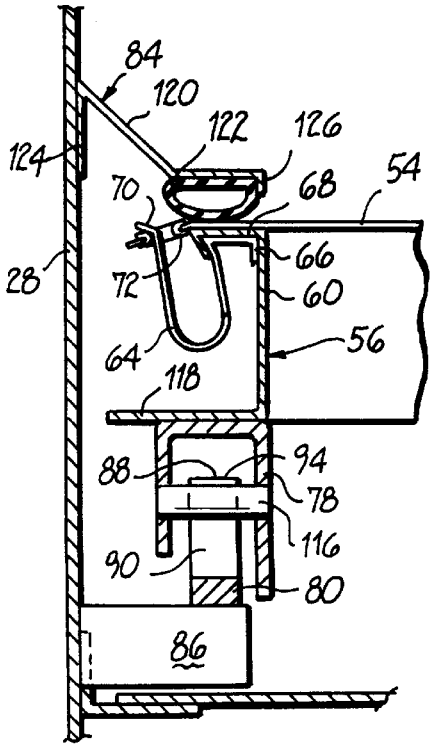

In a presently preferred embodiment, the screen frame 56 is generally rectangular having a pair of spaced first and second longitudinal sides 60 separated by a pair of spaced first and second ends 62*a*, 62*b* proximate the head and foot end 24, 16 of the screening machine 10, respectively. Advantageously, the screen 54 is held in tension and mounted to the peripheral screen frame 56 by a plurality of spring clips 64 as is well known in the industry (FIG. 5). The spring clips 64 are generally U-shaped with a hook-shaped portion 66 projecting from one end thereof that is seated within a similarly shaped flange 68 extending around the upper edge of the screen frame 56 (FIGS. 4 and 4A). A tang 70 extends from the opposite end of the U-shaped spring clip 64 and is inserted through an oval-shaped grommet 72 at the perimeter of the screen 54. The ends of the U-shaped spring clip 64 are slightly compressed together to thereby tension the screen 54 on the screen frame 56.

The present invention includes a screen assembly sealing mechanism 74 as particularly shown in FIGS. 2–4A. The sealing mechanism 74 includes first and second operators 76, each of which are substantially identical to one another but located along either of the longitudinal sides 60 of the screen frame 56. Each operator 76 includes a screen frame lifting rail 78, a seal bar 80 housed within the screen frame lifting rail 78 and an actuator 82 accessible to a user of the screening machine 10 at the foot end 16 of the machine 10. Referring once again to FIG. 2, the screen frame is supported upon the screen frame lifting rail 78 which has a generally inverted U-shaped or open box-shaped configuration. The screen frame lifting rail 78 extends substantially the entire longitudinal length of one of the sides 60 of the screen frame 56.

The screen frame 56 is housed within and secured to a vibratory carrier 84 which transmits the vibratory motion generated by the vibratory drive or motor 48 to the screen frame 56, screen 54 and material being screened during operation of the screening machine 10. In the particular embodiment of the screening machine 10 shown in FIG. 1, the entire machine 10 vibrates, gyrates or otherwise moves during operation. As such, the entire machine 10 shown in FIG. 1 is considered the vibratory carrier 84. Whereas, in other screening machines, a box frame or other structure contains the screen frame and screen and vibrates relative to the remainder of the machine for the screening process and in those applications, the box frame or similar structure will be considered the vibratory carrier.

The seal bar 80 is supported along its length by a plurality, three of which are shown in FIG. 2, of spaced inverted U-shaped channel supports 86 that are preferably welded to the sidewall 28 of the machine 10. The seal bar 80 includes a plurality of ramps 88, each of which includes a ramp or cam surface 90 that is generally linear and inclined at an oblique angle relative to the horizontal direction. Preferably, at least three ramps 88 as shown in FIG. 2 and more preferably four ramps 88 are spaced generally equally along the length of the seal bar 80. Each ramp 88 includes the cam or ramp inclined surface 90 which is bounded at a lower end by a generally horizontal well 92 and at an upper end by a generally horizontal apex 94. Adjacent to the well 92 is a generally vertical detent 96 and adjacent to the apex 94 is a notch 98 in the seal bar 80.

Proximate the foot end 16 of the screening machine 10, each seal bar 80 includes a block 100 having a threaded bore 102 that engages a threaded portion 104 of a shaft 106 of the bolt actuator 82 for the sealing mechanism operator 76. A head 110 of the bolt actuator 82 projects through the foot end wall 26 of the screening machine 10 as shown particularly in FIG. 3. A stop nut 112 is welded or otherwise secured to the shaft 106 of the bolt actuator 82 internal to the screening machine 10. A bushing 114 is seated within an opening in the wall 26 of the screening machine 10 and has a central aperture through which the shaft 106 of the bolt actuator 82 extends. The stop nut 112 acts as a detent and is secured between the block 100 of the seal bar 80 and the bushing 114.

A plurality of links 116 preferably equal in number to the ramps 88 of each operator 76 extend between the spaced sidewalls of the screen frame lifting rail 78. Each link 116 is positioned to engage the cam or ramp inclined surface 90 of one of the ramps 88 on the seal bar 80 for movement there along. The links 116 may be cylindrical rods mounted, welded or otherwise secured between the sidewalls of the screen frame lifting rail 78 or more simply a bolt or other member extending through aligned holes in the sidewalls of the screen frame lifting rail 78.

Referring to FIGS. 4 and 4A, the screen frame 56 has a lower flange 118 which rests upon the screen frame lifting rail 78.

The vibratory carrier 84 includes a seal retaining bracket 120 to which a preferably D-shaped EPDM seal 122 is secured. The seal 122 preferably extends at least the entire length of the associated side 60 of the screen frame 56. The bracket 120 includes a downwardly turned flange 124 that is welded or otherwise secured to the sidewall 28 of the screening machine 10. A downwardly turned protective flange 126 is formed along the terminal edge of the bracket 120 so that when the screening machine 10 is in operation and the screen frame 56 has been lifted by the screen frame lifting rail 78 into sealing engagement with the vibratory carrier 84, material being screened on the screen 54 is prevented from escaping the screen frame 56. Furthermore, the protective flange 126 protects the seal 122 from dust or other contaminants during operation of the screening machine.

The screen frame 56 is raised into sealing engagement with the vibratory carrier 84 and seal 122 in FIG. 4A showing the seal 122 in a compressed configuration. The screen frame 56 is lowered out of sealing engagement as shown in FIG. 4 and the vertical travel in a presently preferred embodiment between the configurations of FIGS. 4 and 4A is approximately three-quarters of an inch. Referring once again to FIGS. 2 and 3, the screen frame 56 as shown in FIG. 3 is similar to that of FIG. 4 without the screen frame 56 in sealing engagement with the seal 122 and vibratory carrier 84; whereas, the screen frame 56 has been raised into sealing engagement in FIG. 2 similar to that shown in FIG. 4A.

Figure 3:
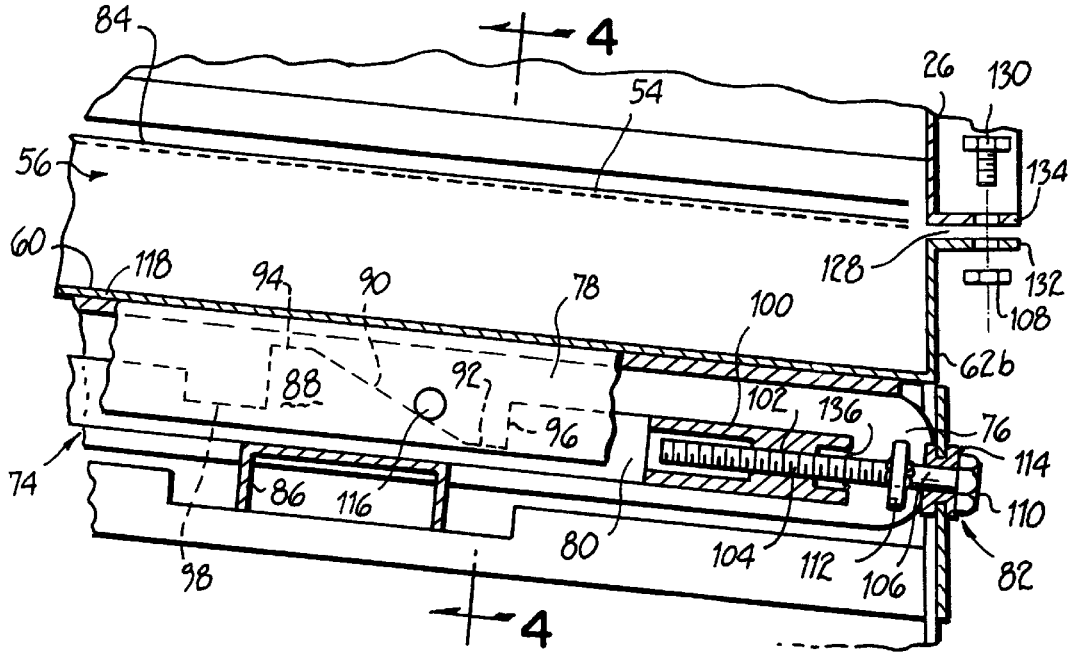
FIG. 3 is an enlarged view of a portion of the sealing mechanism of FIG. 2 showing an actuator, a seal bar and a lifting rail.

Advantageously, the screen frame 56 is installed in a generally horizontal direction through an opening 128 at the foot end 16 of the machine 10 as shown in FIG. 3 without interference by or damage to the seal 122. Alternatively, the screen frame 56 could be inserted in a vertical direction through the top of a screening machine of a different design.

Once installed, the screen frame 56 is raised into sealing engagement by a user solely from the foot end of the machine 10 as follows. The actuator 82 located at the foot end 16 of the machine 10 is rotated in a first direction thereby drawing the seal bar 80 toward the foot end 16 of the machine 10. Continued rotation of the threaded bolt actuator 82 advances the seal bar 80 toward the foot end 16 of the machine 10 thereby translating the seal bar 80 relative to the screen frame lifting rail 78 and associated links 116. The screen frame lifting rail 78 and associated links 116 are restrained from moving horizontally. As such, the seal bar 80 moves in a generally horizontal direction relative to the screen frame lifting rail 78 thereby advancing each link 116 along the associated inclined cam or ramp surface 90 of each ramp 88 and consequently raising the screen frame lifting rail 78 in a generally vertical direction. Movement of the screen frame lifting rail 78 upwardly in a generally vertical direction therefore raises the screen frame 56 likewise upwardly in a generally vertical direction into sealing contact with the seal 122 mounted on the bracket 120 of the vibratory carrier 84 as shown particularly in FIGS. 2 and 4A. It should be appreciated that modifications to this design which, for example, move the lifting links 116 horizontally relative to stationary ramps 88 are within the scope of this invention.

A user conveniently raises an entire side 60 of the screen frame 56 into sealing engagement through each of the individual cooperating ramp and link combinations of the operator 76. Similarly, the entire screen frame 56 is raised into sealing engagement solely by use of each actuator 82 at the foot end 16. Furthermore, the sealing force between the seal 122 on the vibratory carrier 84 and the screen frame 56 is adjustable depending upon the amount of rotation of the threaded drive bolt actuator 82 and the amount of vertical travel of the screen frame lifting rail 78 and screen frame 56. A maximum amount of horizontal travel for the seal bar 80 and consequently the upward vertical movement of the screen frame lifting rail 78 and the screen frame 56 is limited by the detent stop nut 112. In other words, continued rotation of the actuator drive bolt 82 is prevented once the leading edge of the block 100 on the seal bar 80 contacts the stop nut 112 thereby preventing further movement of the seal bar 80 relative to the screen frame lifting rail 78 and vertical upward movement of the screen frame 56.

Conveniently, the entire screen frame 56 can be lifted along both of the sides 60 thereof by a user from a single location, the foot end 16 of the screening machine 10 by actuation of the drive bolt actuators 82. This avoids the need for the user to go from side to side along the length of the machine 10 to actuate individual clamping or screening mechanisms as in known systems. As the actuator 18 is being rotated to raise the screen frame lifting rail 78 and screen frame 56 into sealing engagement with the seal 122 in the vibratory carrier 84, a user can visually inspect the contact between the seal 122 and the screen frame 56 to ensure proper sealing engagement.

The links 116 interact with the inclined cam or ramp surfaces 90 of each ramp 88 and the ease of movement of the links 116 along the inclined surfaces 90 is enhanced by reducing the friction between the two components. The link and ramp engagement is a presently preferred feature of the invention, although other arrangements are possible within the scope of this invention. Other designs may include non-linear or arcuate cam surfaces, a single ramp which engages each of the links of the sealing mechanism operator whereby only a portion of that ramp is engaged by the link as a ramp surface for that individual link or interacting inclined ramp surfaces to name but a few of the possible modifications.

Once the screen frame lifting rail 78 lifts the screen frame 56 into sealing engagement, a bolt 130 and cooperating nut 108 or other mechanical fastener secures an outwardly turned flange 132 at the foot end 16 of the screen frame 56 to an outwardly turned flange 134 on the foot end wall 26 of the screening machine 10 as shown in FIGS. 2 and 3. The bolt 130 and nut 108 maintain the screen frame 56 in sealing engagement, prevent possible downward vertical movement of the screen frame 56 out of sealing engagement with the seal 122 and minimize the load on the links 116 and cooperating ramps 88 of the sealing mechanism 74 during operation of the screening machine 10.

To remove, replace or inspect the screen 54 in the screening machine 10, the bolt 130 and nut 108 are removed from the cooperating flanges 132, 134. Reverse rotation of each drive bolt actuator 82 advances the seal bar 80 towards the head end 24 of the screening machine 10 thereby translating the seal bar 80 and associated cam or ramp surfaces 90 horizontally relative to the screen frame lifting rail 78 and links 116. As a result, the links 116 advance downwardly toward the well 92 of each ramp 88 thereby lowering the screen frame lifting rail 78 and the screen frame 56 supported thereon out of sealing engagement with the seal 122 mounted on the vibratory carrier 84.

To prevent the block 100 from threadably disengaging from the shaft 106 of the actuator 82, the vertically oriented detent 96 is located at the well 92 of each ramp 88 to limit movement of the link 116 relative to the seal bar 80. Preferably, the detent 96 is located at least at each of the ramps 88 closest to the block 100.

Once again, the screen frame 56 can be lowered out of sealing engagement with the seal 122 and corresponding portions of the vibratory carrier 84 by a user at the foot end 16 of the screening machine 10. To minimize dust and other contaminants fouling the threads of the bolt 82 and the interaction between the threaded drive bolt 82 and the block 100, a brush seal 136 is mounted to the block 100 at the leading end thereof to brush or clean the threads as the drive bolt 82 is rotated and the block 100 advances or translates along the length of the threaded section 104 of the drive bolt 82. Similarly, the terminal end of the drive bolt 82 is captured or sealed within the drive block 100 to prevent dust or other contaminants from entering the drive block 100 and fouling the threads. During lowering of the screen frame 56, rotation of the actuator drive bolt 82 does not back out the drive bolt 82 from the block 100 because of the stop nut 112 which limits the translation of the drive bolt 82 thereby moving the seal bar 80 threadably engaged through the block 100 in a horizontal direction. Advantageously, the stop nut 112 allows for faster lowering of the screen frame 56 and screen frame lifting rail 78.

Referring to FIG. 5, a horizontal restraint 138 is preferably provided at the head end 24 of the screen frame 56 and front panel 22 of the screening machine 10. The horizontal restraint 138 includes a bifurcated guide 140 having a pair of spaced members 142 preferably welded to the interior surface of the front panel 22 of the screening machine 10. The leading edges of each member 142 are preferably triangular-shaped and guide or direct a pair of spaced braces 144, 146 on the screen frame 56 during horizontal insertion of the screen frame 56 into the screening machine 10. The spaced braces 144, 146 are separated by an elastomer damper 148 or the like positioned therebetween. One of the spaced braces 144 is welded or otherwise secured to the screen frame bottom flange 132 and the opposing brace 146 is secured by a bolt 150 or other mechanical fastener extending through the braces 144, 146 and the elastomer damper 148. As such, the brace 146 is movable relative to the screen frame 56 and opposing brace 146 when the screen frame 56 is being inserted horizontally, it is aligned within the horizontal plane and centered in the screening machine 10 as the braces 144, 146 are forced between the bifurcated members 142 of the guide 140. As such, the brace 146 deflects toward the attached brace and compresses the elastomer damper 148 and snugly seating the braces 144, 146 between the bifurcated members 142 of the guide 140. The triangular or sloped configuration of the leading edge of the members 142 of the guide 140 assists in centering the braces 144, 146 and attached screen frame 56 relative to the screening machine 10. Nevertheless, the horizontal restraint 138 permits vertical movement of the screen frame 56 and braces 144, 146 relative to the guide and vibratory carrier 84 during raising r lowering of the screen frame 56 or lifting rail 78.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A screening machine comprising:

a vibratory carrier;

a vibratory drive operatively coupled to the vibratory carrier for imparting vibratory motion to the vibratory carrier;

a screen assembly including at least one screen mounted to a peripheral screen frame having spaced first and second sides and a first end, the screen assembly being selectively coupled to the vibratory carrier so that the vibratory motion is transmitted to the screen assembly; and a screen assembly sealing mechanism which selectively moves the screen frame into and out of sealing engagement with the corresponding portions of the vibratory carrier, the screen assembly sealing mechanism including a first operator on the first side of the screen frame and a second operator on the second side of the screen frame spaced from the first side, the operators including at least one actuator being accessible to a user and located at the first end of the screen frame, each of the operators having a plurality of cam surfaces and a plurality of links spaced along the associated side of the screen frame, each link engaging one of the cam surfaces;

wherein upon actuation of each of the operators via the actuator at the first end the associated cam surfaces and links are translated relative to one another to thereby seal the associated side of the screen frame to the corresponding portions of the vibratory carrier and into and out of sealing engagement therewith.

2. The screening machine of claim 1 wherein the screen frame is generally rectangular.

3. The screening machine of claim 1 further comprising:

a plurality of spring clips tensioning the screen within the screen frame.

4. The screening machine of claim 1 further comprising:

a horizontal restraint operatively coupling the screen frame to the vibratory carrier to position the screen frame relative to the vibratory carrier within a generally horizontal plane while permitting generally vertical movement of the screen frame relative to the vibratory carrier.

5. The screening machine of claim 4 wherein the horizontal restraint is located at a second end of the screen frame opposite from the first end.

6. The screening machine of claim 1 wherein the cam surfaces of the operators each further comprise a ramp with a ramp surface inclined relative to a generally horizontal plane.

7. The screening machine of claim 1 wherein each of the operators further comprise:

a seal positioned between at least one of the first and second sides of the screen frame and corresponding portions of the vibratory carrier;

an elongate seal bar extending proximate one of the sides of the screen frame and being operatively coupled to the actuator for generally horizontal movement relative to the screen frame, the cam surfaces of the operator being spaced along the elongate seal bar; and a lifting rail positioned beneath one of the sides of the screen frame and including a plurality of the links, each of the links engaging one of the cam surfaces of the seal bar so that upon actuation of the operator the seal bar and the associated cam surfaces translate relative to the lifting rail and the associated links to raise and lower the screen frame into and out of sealing engagement, respectively, with the vibratory carrier.

8. The screening machine of claim 7 wherein the seal is mounted on the vibratory carrier.

9. The screening machine of claim 7 wherein the actuator is a rotational member threadably coupled to the seal bar.

10. The screening machine of claim 1 further comprising:

a detent on each of the operators to limit the movement of the links relative to the cam surfaces.

11. The screening machine of claim 1 wherein the sealing force of each of the operators is adjustable.

12. A screening machine comprising:

a vibratory carrier;

a vibratory drive operatively coupled to the vibratory carrier for imparting vibratory motion to the vibratory carrier;

a screen assembly including at least one generally rectangular screen mounted to a peripheral generally rectangular screen frame having spaced first and second sides and spaced first and second ends, the screen assembly being selectively coupled to the vibratory carrier so that the vibratory motion is transmitted to the screen assembly;

a seal mounted on the vibratory carrier and positioned between at least the first and second sides of the screen frame and corresponding portions of the vibratory carrier; and a screen assembly sealing mechanism which selectively moves the screen frame into and out of sealing engagement with the corresponding portions of the vibratory carrier, the screen assembly sealing mechanism including a first operator extending the length of the first side of the screen frame and a second operator extending the length of the second side of the screen frame, each of the operators including an actuator being accessible to a user and located at the first end of the screen frame, each of the operators having an elongate seal bar operatively coupled to the actuator for generally horizontal movement relative to the screen frame, the elongate seal bar of each operator including a plurality of spaced ramp surfaces, each operator further including a lifting rail positioned beneath one of the sides of the screen frame and having a plurality of links, each of the links engaging one of the ramp surfaces of the seal bar;

wherein upon actuation of each of the operators via the actuators at the first end the seal bar the ramp surfaces translate relative to the lifting rail and associated links to raise and lower the screen frame into and out of sealing engagement, respectively, with the seal and the vibratory carrier.

13. The screening machine of claim 12 further comprising:

a horizontal restraint located at a second end of the screen frame opposite from the first end and positioning the screen frame relative to the vibratory carrier within a generally horizontal plane while permitting generally vertical movement of the screen frame relative to the vibratory carrier.

14. The screening machine of claim 13 wherein each of the actuators is a rotational member threadably coupled to the seal bar and further includes a detent to limit the movement of the links relative to the ramp surfaces.

15. A sealing mechanism for a screening machine having a vibratory drive operatively coupled to a vibratory carrier for imparting vibratory motion to the vibratory carrier, the screening machine including a screen assembly including at least one screen mounted to a peripheral frame having spaced first and second sides and a first end, the screen assembly being selectively coupled to the vibratory carrier so that the vibratory motion is transmitted to the screen assembly, the sealing mechanism comprising:

a seal positioned between at least the first and second sides of the screen frame and corresponding portions of the vibratory carrier; and a first operator on the first side of the screen frame and a second operator on the second side of the screen frame spaced from the first side, the operators selectively moving the screen frame into and out of sealing engagement with the corresponding portions of the vibratory carrier and including at least one actuator being accessible to a user and located at the first end of the screen frame, each of the operators having a plurality of cam surfaces and a plurality of links spaced along the associated side of the screen frame, each link engaging one of the cam surfaces;

wherein upon actuation of each of the operators via the actuators at the first end the cam surfaces and associated links are translated relative to one another to thereby seal the associated side of the screen frame to the corresponding portions of the vibratory carrier.

16. The sealing mechanism of claim 15 further comprising:

a horizontal restraint operatively coupling the screen frame to the vibratory carrier to position the screen frame relative to the vibratory carrier within a generally horizontal plane while permitting generally vertical movement of the screen frame relative to the vibratory carrier.

17. The sealing mechanism of claim 16 wherein the horizontal restraint is located at a second end of the screen frame opposite from the first end.

18. The sealing mechanism of claim 15 wherein the cam surfaces of the operators each further comprise a ramp with a ramp surface inclined relative to a generally horizontal plane.

19. The sealing mechanism of claim 15 wherein each of the operators further comprise:

an elongate seal bar extending the length of one of the sides of the screen frame and being operatively coupled to the actuator for generally horizontal movement relative to the screen frame, the cam surfaces of the operator being spaced along the elongate seal bar; and a lifting rail positioned beneath one of the sides of the screen frame and including a plurality of the links, each of the links engaging one of the cam surfaces of the seal bar so that upon actuation of the operator the seal bar and cam surfaces thereof translate relative to the lifting rail and the associated links to raise and lower the screen frame into and out of sealing engagement, respectively, with the vibratory carrier.

20. The sealing mechanism of claim 19 wherein the seal is mounted on the vibratory carrier.

21. The sealing mechanism of claim 19 wherein the actuator is a rotational member threadably coupled to the seal bar.

22. The sealing mechanism of claim 15 further comprising:

a detent on each of the operators to limit the movement of the links relative to the cam surfaces.

23. The sealing mechanism of claim 15 wherein the sealing force of each of the operators is adjustable.

24. A method of sealing a screen frame having a screen within a screening machine, the method comprising the steps of:

inserting the screen frame and screen within a vibratory carrier of the screening machine, the vibratory carrier imparting vibratory motion to the screen frame and the screen during use of the screening machine, a seal being positioned between at least first and second spaced sides of the screen frame and corresponding portions of the vibratory carrier;

actuating a mechanical sealing mechanism having portions extending along the length of the first and second sides of the screen frame from a first end of the screen frame to selectively move the screen frame into and out of sealing engagement with the vibratory carrier and the seal; and translating a plurality of cam surfaces of the sealing mechanism relative to a corresponding plurality of links, each of the links being associated with one of the cam surfaces to thereby move the screen frame generally vertically relative to the corresponding portions of the vibratory carrier and into and out of sealing engagement therewith.

25. The method of claim 24 wherein the screen frame is inserted generally horizontally into the vibratory carrier.

26. The method of claim 24 wherein the screen frame is inserted generally vertically into the vibratory carrier.

27. The method of claim 24 wherein substantially the entire first and second sides of the screen frame are raised vertically into sealing engagement with the seal mounted on the vibratory carrier.

28. The method of claim 24 further comprising:

restraining movement of the screen frame relative to the vibratory carrier within a generally horizontal plane; and centering the screen frame relative to the vibratory carrier within the generally horizontal plane.

29. The method of claim 28 wherein the restraining and centering does not inhibit movement of the screen frame relative to the vibratory carrier in a generally vertical direction.

30. The method of claim 24 further comprising:

tensioning the screen within the screen frame with spring clips.

31. The method of claim 24 further comprising:

adjusting a sealing force of the mechanical sealing mechanism from the first end of the screen frame.

32. The method of claim 24 wherein the actuating comprises rotation of a threaded member coupled to the cam surfaces of the sealing mechanism.

* * * * *